US008763570B2

(12) United States Patent
Hayman et al.

(10) Patent No.: US 8,763,570 B2
(45) Date of Patent: Jul. 1, 2014

(54) ENGINE ASSEMBLY INCLUDING MULTIPLE BORE CENTER PITCH DIMENSIONS

(75) Inventors: Alan W. Hayman, Romeo, MI (US); Terry Wayne Black, Clarkston, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 176 days.

(21) Appl. No.: 13/232,297

(22) Filed: Sep. 14, 2011

(65) Prior Publication Data

US 2013/0061823 A1 Mar. 14, 2013

(51) Int. Cl.

| | |
|---|---|
| ***F02B 75/20*** | (2006.01) |
| ***F02B 75/18*** | (2006.01) |
| ***F02B 75/22*** | (2006.01) |
| ***B21D 53/84*** | (2006.01) |

(52) U.S. Cl.
USPC ..... 123/58.1; 123/52.1; 123/54.5; 29/888.01

(58) Field of Classification Search
USPC ..... 123/52.1, 54.5, 58.1; 29/888.01
See application file for complete search history.

(56) References Cited

U.S. PATENT DOCUMENTS

| | | | | | |
|---|---|---|---|---|---|
| 1,512,673 | A | * | 10/1924 | Breguet | 123/68 |
| 1,746,728 | A | * | 2/1930 | Ensign | 123/68 |
| 2,091,410 | A | * | 8/1937 | Mallory | 123/143 B |
| 2,349,967 | A | * | 5/1944 | Javal | 123/68 |
| 3,867,816 | A | * | 2/1975 | Barrett | 60/682 |
| 4,094,286 | A | * | 6/1978 | Kuroda et al. | 123/568.2 |
| 4,218,880 | A | * | 8/1980 | Kuroda et al. | 60/278 |
| 4,350,129 | A | * | 9/1982 | Nakajima et al. | 123/310 |
| 4,506,634 | A | * | 3/1985 | Kerrebrock | 123/68 |
| 4,676,067 | A | * | 6/1987 | Pinto | 60/525 |
| 5,228,194 | A | * | 7/1993 | Broughton et al. | 29/888.05 |
| 5,857,436 | A | * | 1/1999 | Chen | 123/70 R |
| 5,894,726 | A | * | 4/1999 | Monnier | 60/274 |
| 6,666,183 | B2 | * | 12/2003 | Abe et al. | 123/195 R |
| 7,721,541 | B2 | * | 5/2010 | Roberts et al. | 60/605.2 |
| 7,730,856 | B2 | * | 6/2010 | Van Avermaete | 123/48 B |
| 7,941,994 | B2 | * | 5/2011 | Surnilla et al. | 60/285 |
| 8,561,599 | B2 | * | 10/2013 | Gingrich et al. | 123/568.17 |
| 2002/0073980 | A1 | * | 6/2002 | Abe et al. | 123/572 |
| 2009/0277402 | A1 | * | 11/2009 | Park | 123/58.8 |

FOREIGN PATENT DOCUMENTS

| | | | | |
|---|---|---|---|---|
| EP | 621403 | A1 * | 10/1994 | F02B 75/02 |

* cited by examiner

*Primary Examiner* — Lindsay Low
*Assistant Examiner* — Tea Holbrook
(74) *Attorney, Agent, or Firm* — Harness, Dickey & Pierce, P.L.C.

(57) ABSTRACT

An engine assembly includes an engine block defining a first cylinder bore, a second cylinder bore directly adjacent to the first cylinder bore and a third cylinder bore directly adjacent to the second cylinder bore. The engine block defines a first distance from a diametrical center of the first cylinder bore to a diametrical center of the second cylinder bore and defines a second distance from the diametrical center of the second cylinder bore to a diametrical center of the third cylinder bore. The first distance is different than the second distance.

18 Claims, 4 Drawing Sheets

ENGINE ASSEMBLY INCLUDING MULTIPLE BORE CENTER PITCH DIMENSIONS

FIELD

The present disclosure relates to engine cylinder bore geometry.

BACKGROUND

This section provides background information related to the present disclosure which is not necessarily prior art.

Internal combustion engines may combust a mixture of air and fuel in cylinders and thereby produce drive torque. Combustion of the air-fuel mixture produces exhaust gases. Engines may include intake ports to direct air flow to the combustion chambers. Typically, the cylinders have a common spacing along the engine block based on the size of the largest cylinder bore even in arrangements including varying cylinder bore sizes along the length of the engine block.

SUMMARY

An engine assembly may include an engine block defining a first cylinder bore, a second cylinder bore directly adjacent to the first cylinder bore and a third cylinder bore directly adjacent to the second cylinder bore. The engine block may define a first distance from a diametrical center of the first cylinder bore to a diametrical center of the second cylinder bore and may define a second distance from the diametrical center of the second cylinder bore to a diametrical center of the third cylinder bore. The first distance may be different than the second distance.

In another arrangement, an engine assembly may include an engine block defining a first cylinder bore and a second cylinder bore directly adjacent to the first cylinder bore. The first cylinder bore may define a first circumference and a first diameter and the second cylinder bore may define a second circumference and a second diameter different than the first diameter. A first radial distance may be defined between a radially outermost point on the first circumference relative to the second cylinder bore and a radially outermost point on the second circumference relative to the first cylinder bore. The first radial distance may be less than 205 percent of the greater of the first and second diameters.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Figure 1:
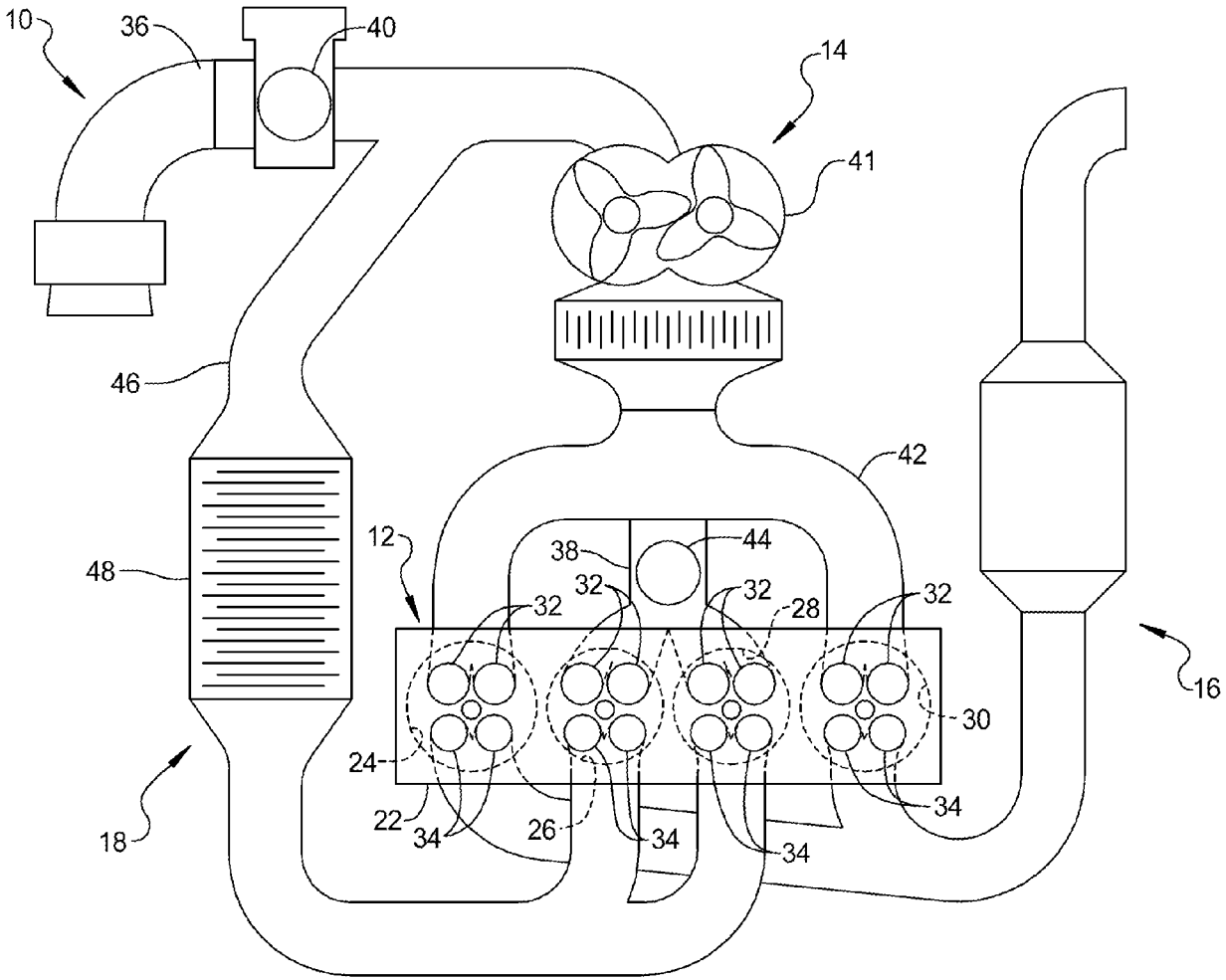
FIG. 1 is a schematic illustration of an engine assembly according to the present disclosure.

An engine assembly 10 is illustrated in FIG. 1 and may include an engine structure 12, an air intake assembly 14, an exhaust system 16 and an exhaust gas recirculation (EGR) system 18. The engine structure 12 may include an engine block 20 (FIG. 2) and a cylinder head 22 coupled to the engine block 20. The engine block 20 may define first, second, third and fourth cylinder bores 24, 26, 28, 30. In the example illustrated in FIGS. 1 and 2, the first and fourth cylinder bores 24, 30 may define working cylinders and the second and third cylinder bores 26, 28 may define dedicated EGR cylinders. The cylinder head 22 may define intake ports 32 and exhaust ports 34 in communication with the cylinder bores 24, 26, 28, 30.

The air intake assembly 14 may include a first intake air flow path 36 in communication with the first and fourth cylinder bores 24, 30 and the second and third cylinder bores 26, 28. The first intake air flow path 36 may include a first throttle valve 40 and a boost mechanism 41, such as a supercharger. An intake manifold 42 may provide communication between the first intake air flow path 36 and the first and fourth cylinder bores 24, 30. A second intake air flow path 38 may include a second throttle valve 44 and may provide communication between the first intake air flow path 36 and the second and third cylinder bores 26, 28.

The intake ports 32 from the first and fourth cylinder bores 24, may be in communication with the first intake air flow path 36 and the intake ports 32 from the second and third cylinder bores 26, 28 may be in communication with the second intake air flow path 38. The exhaust ports 34 from the first and fourth cylinder bores 24, 30 may be in communication with the exhaust system 16 and the exhaust ports 34 from the second and third cylinder bores 26, 28 may be in communication with the EGR system 18. The EGR system 18 may be in communication with the first intake air flow path 36 and provide communication between the exhaust ports 34 from the second and third cylinder bores 26, 28 and the intake ports 32 from the first and fourth cylinder bores 24, 30. The EGR system 18 may provide communication between the exhaust ports 34 from the second and third cylinder bores 26, 28 and the intake ports 32 from the first and fourth cylinder bores 24, 30 via the intake manifold 42. The EGR system 18 may include an exhaust gas flow path 46 providing communication between the exhaust ports 34 from the second and third cylinder bores 26, 28 and the first intake air flow path 36 and may include an EGR cooler 48.

Figure 2:
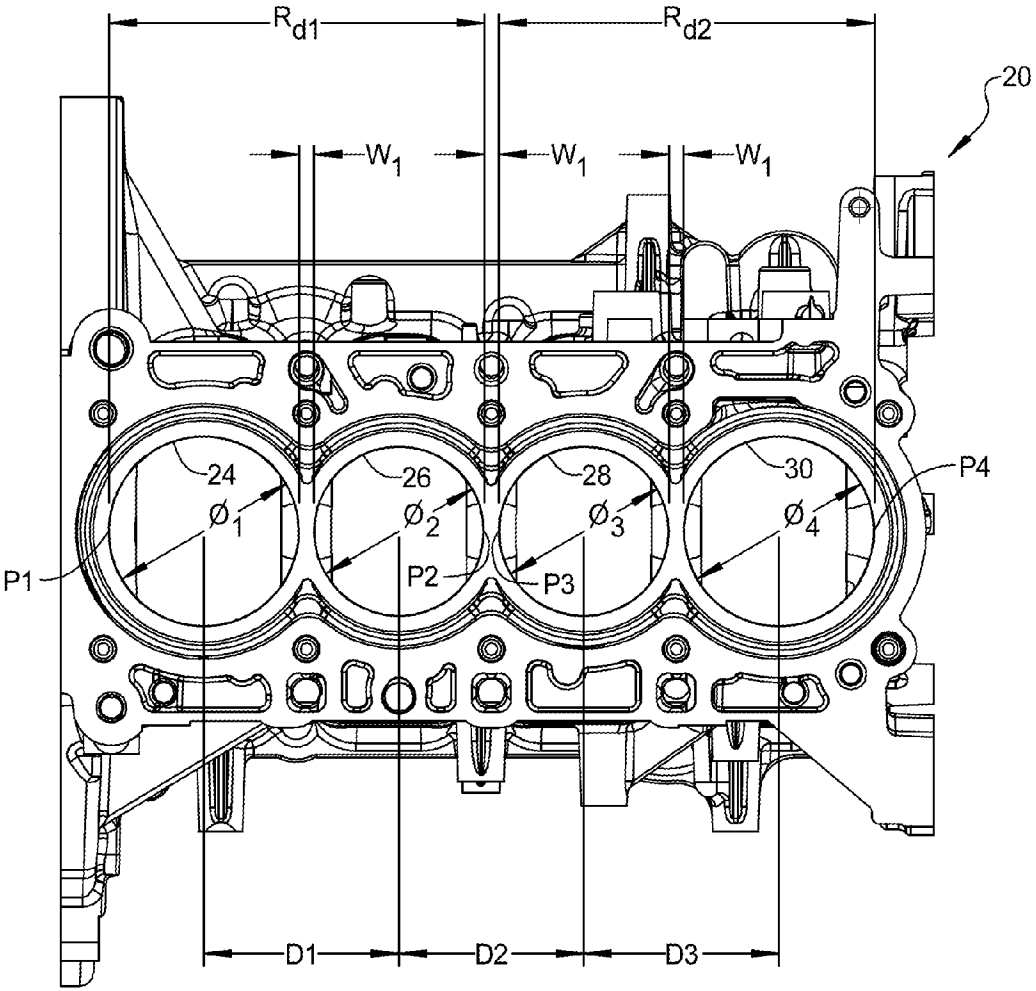
FIG. 2 is a top view of the engine block from the engine assembly of FIG. 1.

As seen in FIG. 2, the second cylinder bore 26 may be directly adjacent to the first cylinder bore 24, the third cylinder bore 28 may be directly adjacent to the second cylinder bore 26 and the fourth cylinder bore 30 may be directly adjacent to the third cylinder bore 28. The first cylinder bore 24 may define a first diameter ($\phi_1$), the second cylinder bore 26 may define a second diameter ($\phi_2$), the third cylinder bore 28 may define a third diameter ($\phi_3$), and the fourth cylinder bore 30 may define a fourth diameter ($\phi_4$). The first and fourth diameters ($\phi_1$, $\phi_4$) may be equal to one another and the second and third diameters ($\phi_2$, $\phi_3$) may be equal to one another. In the present non-limiting example, the first and fourth diameters ($\phi_1$, $\phi_4$) may be greater than the second and third diameters ($\phi_2$, $\phi_3$). More specifically, the first and fourth diameters ($\phi_1$, $\phi_4$) may be at least ten percent greater than the second and third diameters ($\phi_2$, $\phi_3$).

The engine block 20 may define a first distance (D1) from a diametrical center of the first cylinder bore 24 to a diametrical center of the second cylinder bore 26. The engine block 20 may define a second distance (D2) from a diametrical center of the second cylinder bore 26 to a diametrical center of the third cylinder bore 28. The engine block 20 may define a third distance (D3) from a diametrical center of the third cylinder bore 28 to a diametrical center of the fourth cylinder bore 30. The first and third distances (D1, D3) may be different from the second distance (D2). In the present non-limiting example, the first and third distances (D1, D3) may be greater than the second distance (D2).

Therefore, the bore spacing along the engine block 20 may provide an overall reduced length of the engine block 20 relative to an arrangement having an equal spacing between cylinder bores based on the largest cylinder bore size. The reduced length of the engine block 20 may alternatively be characterized based on the radial distances between adjacent cylinder bores.

In the example shown in FIG. 2, a first radial distance ($R_{d1}$) is defined from a radially outermost point (P1) on the circumference of the first cylinder bore 24 relative to the second cylinder bore 26 to a radially outermost point (P2) on the circumference of the second cylinder bore 26 relative to the first cylinder bore 24. A second radial distance ($R_{d2}$) is defined from a radially outermost point (P3) on the circumference of the third cylinder bore 28 relative to the fourth cylinder bore 30 to a radially outermost point (P4) on the circumference of the fourth cylinder bore 30 relative to the third cylinder bore 28. The first radial distance ($R_{d1}$) is equal to the sum of the first and second diameters ($\phi_1$, $\phi_2$) and the wall thickness ($w_1$) defined between the first and second cylinder bores 24, 26. Similarly, the second radial distance ($R_{d2}$) is equal to the sum of the third and fourth diameters ($\phi_3$, $\phi_4$) and the wall thickness ($w_1$) defined between the third and fourth cylinder bores 28, 30. The wall thickness ($w_1$) may be the same between the first and second cylinder bores 24, 26, between the second and third cylinder bores 26, 28 and between the third and fourth cylinder bores 28, 30.

The first radial distance ($R_{d1}$) may be less than two hundred and five percent of the first diameter ($\phi_1$) (i.e., the greater of the first and second diameters ($\phi_1$, $\phi_2$)). Similarly, the second radial distance ($R_{d2}$) may be less than two hundred and five percent of the fourth diameter ($\phi_4$) (i.e., the greater of the third and fourth diameters ($\phi_3$, $\phi_4$)). In the present non-limiting example, the first radial distance ($R_{d1}$) is less than twice the first diameter ($\phi_1$) and the second radial distance ($R_{d2}$) is less than twice the fourth diameter ($\phi_4$).

It is understood that the present disclosure may be applied to arrangements where the location of the working cylinders and EGR cylinders are reversed (i.e., first and fourth cylinder bores 24, 30 located between the second and third cylinder bores 26, 28). Further, while described in combination with a four cylinder inline engine configuration, it is understood that the present teachings apply to any number of piston-cylinder arrangements and a variety of reciprocating engine configurations including, but not limited to, V-engines, inline engines, and horizontally opposed engines, as well as both overhead cam and cam-in-block configurations.

Figure 3:
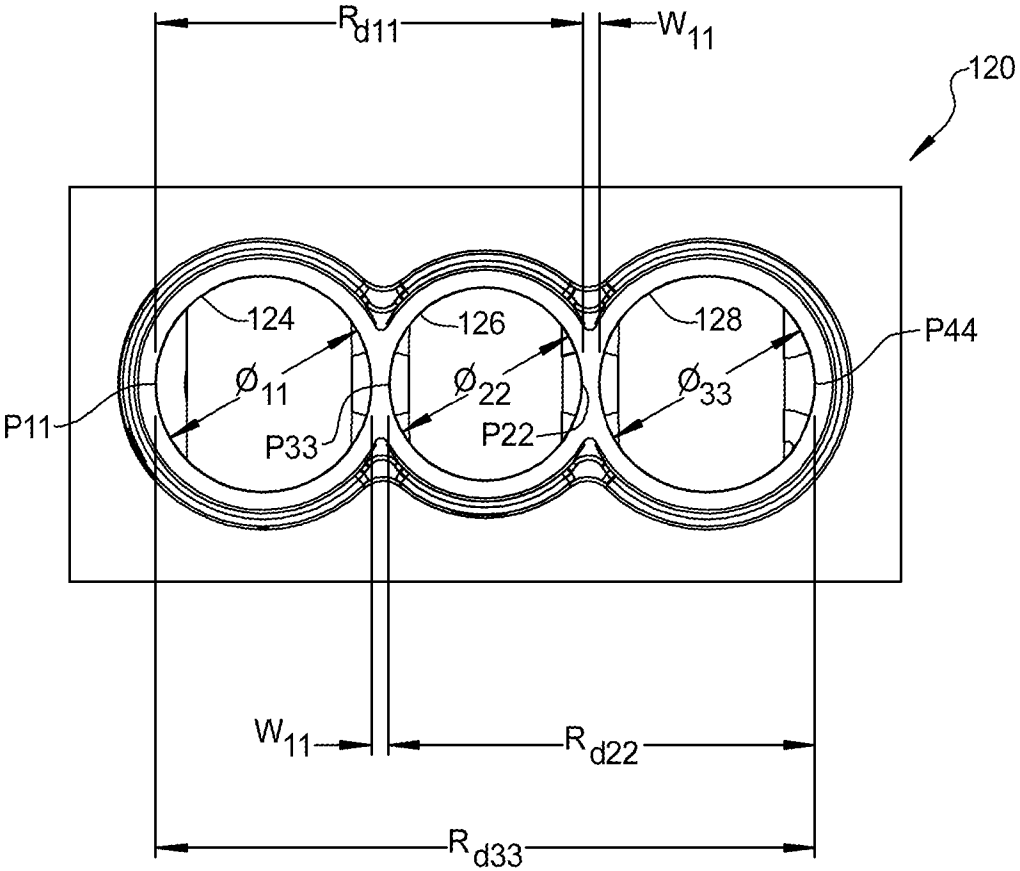
FIG. 3 is a schematic illustration of an alternate engine block according to the present disclosure.

FIG. 3 illustrates an alternate engine block 120 including three cylinder bores 124, 126, 128. The engine block 120 may be a three cylinder engine or may form one bank of a V6 engine. In the example shown in FIG. 3, the second cylinder bore 126 is directly adjacent to the first cylinder bore 124 and the third cylinder bore 128 is directly adjacent to the second cylinder bore 126. The first cylinder bore 124 may define a first diameter ($\phi_{11}$), the second cylinder bore 126 may define a second diameter ($\phi_{22}$), and the third cylinder bore 128 may define a third diameter ($\phi_{33}$). The first and third diameters ($\phi_{11}$, $\phi_{33}$) may be equal to one another. In the present non-limiting example, the first and third diameters ($\phi_{11}$, $\phi_{33}$) may be greater than the second diameter ($\phi_{22}$). More specifically, the first and third diameters ($\phi_{11}$, $\phi_{33}$) may be at least ten percent greater than the second diameter ($\phi_{22}$).

In the example shown in FIG. 3, a first radial distance ($R_{d11}$) is defined from a radially outermost point (P11) on the circumference of the first cylinder bore 124 relative to the second cylinder bore 126 to a radially outermost point (P22) on the circumference of the second cylinder bore 126 relative to the first cylinder bore 124. A second radial distance ($R_{d22}$) is defined from a radially outermost point (P33) on the circumference of the second cylinder bore 126 relative to the third cylinder bore 128 to a radially outermost point (P44) on the circumference of the third cylinder bore 128 relative to the second cylinder bore 126. The first radial distance ($R_{d11}$) is equal to the sum of the first and second diameters ($\phi_{11}$, $\phi_{22}$) and the wall thickness ($w_{11}$) defined between the first and second cylinder bores 124, 126. Similarly, the second radial distance ($R_{d22}$) is equal to the sum of the second and third diameters ($\phi_2$, $\phi_3$) and the wall thickness ($w_{11}$) defined between the second and third cylinder bores 126, 128. The wall thickness ($w_{11}$) may be the same between the first and second cylinder bores 124, 126 and between the second and third cylinder bores 126, 128.

The first radial distance ($R_{d11}$) may be less than two hundred and five percent of the first diameter ($\phi_{11}$) (i.e., the greater of the first and second diameters ($\phi_{11}$, $\phi_{22}$)). Similarly, the second radial distance ($R_{d22}$) may be less than two hundred and five percent of the third diameter ($\phi_{33}$) (i.e., the greater of the second and third diameters ($\phi_{22}$, $\phi_{33}$)). In the present non-limiting example, the first radial distance ($R_{d11}$) is less than twice the first diameter ($\phi_{11}$) and the second radial distance ($R_{d22}$) is less than twice the third diameter ($\phi_{33}$). A third radial distance ($R_{d33}$) is defined from point (P11) to point (P44) and may be less than three hundred and ten percent of the first diameter ($\phi_{11}$).

Figure 4:
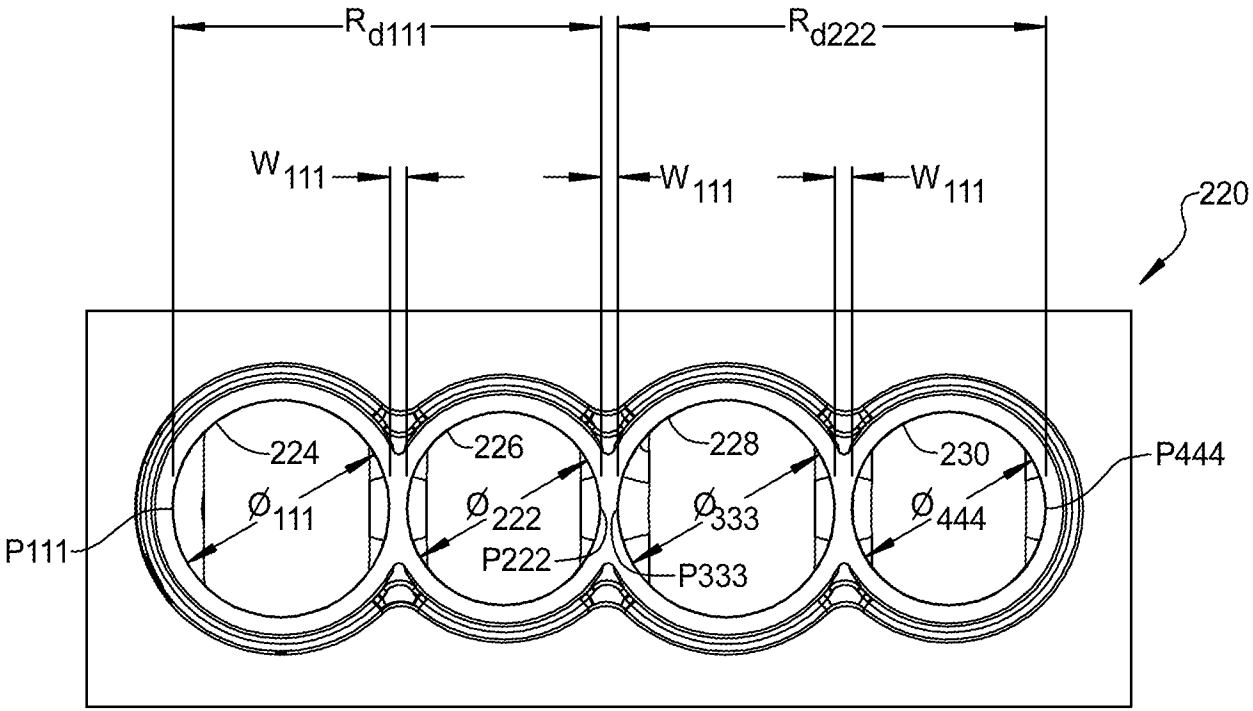
FIG. 4 is schematic illustration of an additional alternate engine block according to the present disclosure.

FIG. 4 illustrates an alternate engine block 220 including a four cylinder arrangement. In the example shown in FIG. 4, the second cylinder bore 226 is directly adjacent to the first cylinder bore 224, the third cylinder bore 228 is directly adjacent to the second cylinder bore 226 and the fourth cylinder bore 230 is directly adjacent to the third cylinder bore 228. The first cylinder bore 224 may define a first diameter ($\phi_{111}$), the second cylinder bore 226 may define a second diameter ($\phi_{222}$), the third cylinder bore 228 may define a third diameter ($\phi_{333}$), and the fourth cylinder bore 230 may define a fourth diameter ($\phi_{444}$). The first and third diameters ($\phi_{111}$, $\phi_{333}$) may be equal to one another and the second and fourth diameters ($\phi_{222}$, $\phi_{444}$) may be equal to one another. In the present non-limiting example, the first and third diameters ($\phi_{111}$, $\phi_{333}$) may be greater than the second and fourth diameters ($\phi_{222}$, $\phi_{444}$). More specifically, the first and third diameters ($\phi_{111}$, $\phi_{333}$) may be at least ten percent greater than the second and fourth diameters ($\phi_{222}$, $\phi_{444}$).

In the example shown in FIG. 4, a first radial distance ($R_{d111}$) is defined from a radially outermost point (P111) on the circumference of the first cylinder bore 224 relative to the second cylinder bore 226 to a radially outermost point (P222) on the circumference of the second cylinder bore 226 relative to the first cylinder bore 224. A second radial distance ($R_{d222}$) is defined from a radially outermost point (P333) on the circumference of the third cylinder bore 228 relative to the fourth cylinder bore 230 to a radially outermost point (P444) on the circumference of the fourth cylinder bore 230 relative to the third cylinder bore 228. The first radial distance ($R_{d111}$) is equal to the sum of the first and second diameters ($\phi_{111}$, $\phi_{222}$) and the wall thickness ($w_{111}$) defined between the first and second cylinder bores 224, 226. Similarly, the second radial distance ($R_{d222}$) is equal to the sum of the third and fourth diameters ($\phi_{333}$, $\phi_{444}$) and the wall thickness ($w_{111}$) defined between the third and fourth cylinder bores 228, 230. The wall thickness ($w_{111}$) may be the same between the first and second cylinder bores 224, 226, between the second and third cylinder bores 226, 228 and between the third and fourth cylinder bores 228, 230.

The first radial distance ($R_{d111}$) may be less than two hundred and five percent of the first diameter ($\phi_{111}$) (i.e., the greater of the first and second diameters ($\phi_{111}$, $\phi_{222}$)). Similarly, the second radial distance ($R_{d222}$) may be less than two hundred and five percent of the third diameter ($\phi_3$) (i.e., the greater of the third and fourth diameters ($\phi_{333}$, $\phi_{444}$)). In the present non-limiting example, the first radial distance ($R_{d111}$) is less than twice the first diameter ($\phi_{111}$) and the second radial distance ($R_{d222}$) is less than twice the third diameter ($\phi_{444}$).

What is claimed is:

1. An internal combustion engine assembly comprising:

an engine block defining a first cylinder bore, a second cylinder bore directly adjacent to the first cylinder bore and a third cylinder bore directly adjacent to the second cylinder bore, wherein said first cylinder bore defines a working cylinder bore and at least one of said second and third cylinder bores defines a dedicated EGR cylinder bore;

the engine block defining a first distance from a diametrical center of the first cylinder bore to a diametrical center of the second cylinder bore and defining a second distance from the diametrical center of the second cylinder bore to a diametrical center of the third cylinder bore;

the first distance being different than the second distance;

an air intake assembly including an intake air flow path in communication with a throttle valve and an intake manifold; and a cylinder head coupled to the intake manifold, the cylinder head being coupled to the engine block and defining an intake port in communication with the first cylinder bore and an exhaust port in communication with the second cylinder bore, the exhaust port being in communication with the intake manifold and providing exhaust gas from the second cylinder bore to the first cylinder bore.

2. The internal combustion engine assembly of claim 1, wherein the first cylinder bore defines a first diameter that is not equal to a second diameter defined by the second cylinder bore.

3. The internal combustion engine assembly of claim 2, wherein the first diameter is greater than the second diameter.

4. The internal combustion engine assembly of claim 3, wherein the first distance is greater than the second distance.

5. The internal combustion engine assembly of claim 2, wherein the first cylinder bore defines a first circumference and the second cylinder bore defines a second circumference, a radial distance defined between a radially outermost point on the first circumference relative to the second cylinder bore and a radially outermost point on the second circumference relative to the first cylinder bore being less than twice the greater of the first and second diameters.

6. The internal combustion engine assembly of claim 1, wherein the engine block defines a fourth cylinder bore directly adjacent to the third cylinder bore and defines a third distance from a diametrical center of the third cylinder bore to a diametrical center of the fourth cylinder bore with the second and third distances being different from one another.

7. The internal combustion engine assembly of claim 6, wherein the first and third distances are greater than the second distance.

8. The internal combustion engine assembly of claim 7, wherein the first cylinder bore defines a first diameter, the second cylinder bore defines a second diameter, the third cylinder bore defines a third diameter and the fourth cylinder bore defines a fourth diameter, the first and fourth diameters being different than the second and third diameters.

9. The internal combustion engine assembly of claim 8, wherein the first and fourth diameters are greater than the second and third diameters.

10. An internal combustion engine assembly comprising:

an engine block defining a first working cylinder bore and a second dedicated EGR cylinder bore directly adjacent to the first cylinder bore;

the first working cylinder bore defining a first circumference and a first diameter;

the second dedicated EGR cylinder bore defining a second circumference and a second diameter different than the first diameter;

a first radial distance defined between a radially outermost point on the first circumference relative to the second dedicated EGR cylinder bore and a radially outermost point on the second circumference relative to the first working cylinder bore being less than 205 percent of the greater of the first and second diameters;

an air intake assembly including an intake air flow path in communication with a throttle valve and an intake manifold; and a cylinder head coupled to the intake manifold, the cylinder head being coupled to the engine block and defining an intake port in communication with the first working cylinder bore and an exhaust port in communication with the second dedicated EGR cylinder bore, the exhaust port being in communication with the intake manifold and providing exhaust gas from the second dedicated EGR cylinder bore to the first working cylinder bore.

11. The internal combustion engine assembly of claim 10, wherein the first diameter is greater than the second diameter and the radial distance is less than twice the first diameter.

12. The internal combustion engine assembly of claim 10, wherein the first diameter is greater than the second diameter and the engine block defines a third working cylinder bore directly adjacent to the second dedicated EGR cylinder bore and defining a third diameter greater than the second diameter.

13. The internal combustion engine assembly of claim 12, wherein the third working cylinder bore defines a third circumference, a second radial distance defined between a radially outermost point on the third circumference relative to the second dedicated EGR cylinder bore and the radially outermost point on the second circumference relative to the third working cylinder bore being less than 205 percent of the third diameter.

14. The internal combustion engine assembly of claim 10, wherein the first diameter is greater than the second diameter and the engine block defines a third dedicated EGR cylinder bore directly adjacent to the second dedicated EGR cylinder bore and a fourth working cylinder bore directly adjacent to the third dedicated EGR cylinder bore, the third dedicated EGR cylinder bore defining a third diameter less than the first diameter and the fourth working cylinder bore defining a fourth diameter greater than the second diameter.

15. The internal combustion engine assembly of claim 14, the third dedicated EGR cylinder bore defines a third circumference and the fourth working cylinder bore defines a fourth circumference, a second radial distance defined between a radially outermost point on the third circumference relative to the fourth working cylinder bore and a radially outermost point on the fourth circumference relative to the third dedicated EGR cylinder bore being less than 205 percent of the fourth diameter.

16. The internal combustion engine assembly of claim 10, wherein the engine block defines a third dedicated EGR cylinder bore directly adjacent to the second dedicated EGR cylinder bore, the engine block defining a first distance from a diametrical center of the first working cylinder bore to a diametrical center of the second dedicated EGR cylinder bore and a second distance from a diametrical center of the second dedicated EGR cylinder bore to a diametrical center of the third dedicated EGR cylinder bore, the first and second distances being different from one another.

17. An internal combustion engine assembly comprising:

an engine block defining a first cylinder bore and a second cylinder bore directly adjacent to the first cylinder bore;

the first cylinder bore defining a first circumference and a first diameter;

the second cylinder bore defining a second circumference and a second diameter different than the first diameter;

a first radial distance defined between a radially outermost point on the first circumference relative to the second cylinder bore and a radially outermost point on the second circumference relative to the first cylinder bore being less than 205 percent of the greater of the first and second diameters;

wherein the first diameter is greater than the second diameter and the engine block defines a third cylinder bore directly adjacent to the second cylinder bore and defining a third diameter greater than the second diameter; and wherein the engine block defines a fourth cylinder bore directly adjacent to the third cylinder bore and defining a fourth diameter less than the third diameter;

an air intake assembly including an intake air flow path in communication with a throttle valve and an intake manifold; and a cylinder head coupled to the intake manifold, the cylinder head being coupled to the engine block and defining an intake port in communication with the first cylinder bore and an exhaust port in communication with the second cylinder bore, the exhaust port being in communication with the intake manifold and providing exhaust gas from the second cylinder bore to the first cylinder bore.

18. The internal combustion engine assembly of claim 17, wherein the third cylinder bore defines a third circumference and the fourth cylinder bore defines a fourth circumference, a second radial distance defined between a radially outermost point on the third circumference relative to the fourth cylinder bore and a radially outermost point on the fourth circumference relative to the third cylinder bore being less than 205 percent of the third diameter.

* * * * *